US011486408B2

(12) United States Patent
Hall et al.

(10) Patent No.: US 11,486,408 B2
(45) Date of Patent: Nov. 1, 2022

(54) SYSTEMS AND METHODS FOR ADAPTING COMPRESSOR CONTROLLER BASED ON FIELD CONDITIONS

(71) Applicant: Compressor Controls Corporation, Des Moines, IA (US)

(72) Inventors: Richard Hall, Arvada, CO (US); Thomas Pesek, Ankeny, IA (US); Serge Staroselsky, Des Moines, IA (US); Michael Lev Tolmatsky, Des Moines, IA (US)

(73) Assignee: Compressor Controls LLC, Des Moines, IA (US)

( * ) Notice: Subject to any disclaimer, the term of this patent is extended or adjusted under 35 U.S.C. 154(b) by 343 days.

(21) Appl. No.: 16/783,234

(22) Filed: Feb. 6, 2020

(65) Prior Publication Data

US 2020/0248707 A1 Aug. 6, 2020

Related U.S. Application Data

(60) Provisional application No. 62/801,759, filed on Feb. 6, 2019.

(51) Int. Cl.
*F04D 27/02* (2006.01)

(52) U.S. Cl.
CPC ..... *F04D 27/0223* (2013.01)

(58) Field of Classification Search
CPC ..... F04D 27/0223
See application file for complete search history.

(56) References Cited

U.S. PATENT DOCUMENTS 4,949,276 A * 8/1990 Staroselsky ..... F04D 27/001 700/282
5,947,680 A 9/1999 Harada et al.
6,059,522 A 5/2000 Gertz et al.
6,343,251 B1 1/2002 Herron et al.
(Continued)

FOREIGN PATENT DOCUMENTS

CN 108131172 A 6/2018
GB 2581467 A * 8/2020 ..... F04D 27/001
JP 2012067748 A 4/2012

OTHER PUBLICATIONS

International Search Report issued in corresponding International Application No. PCT/US2020/016916 dated May 18, 2020, 15 pages.

(Continued)

*Primary Examiner* — Richard A Edgar
(74) *Attorney, Agent, or Firm* — Snyder, Clark, Lesch & Chung, LLP

(57) ABSTRACT

An antisurge controller for a turbocompressor system stores multiple control algorithms in a memory for the antisurge controller. The antisurge controller identifies capabilities of field devices in the turbocompressor system. The field devices include an antisurge valve and multiple sensors. The antisurge controller selects one of the multiple control algorithms based on the identified capabilities and applies the selected control algorithm to the turbocompressor system. The selected control algorithm provides the smallest surge control margin, of the surge control margins in the multiple control algorithms, that are supported by the identified capabilities.

25 Claims, 8 Drawing Sheets

(56) References Cited

U.S. PATENT DOCUMENTS

| | | | |
|---|---|---|---|
| 8,437,941 | B2 | 5/2013 | Chandler |
| 2012/0207622 | A1 | 8/2012 | Ebisawa et al. |
| 2016/0123341 | A1 | 5/2016 | Higashi |
| 2016/0195026 | A1 | 7/2016 | Sopcic et al. |
| 2018/0023490 | A1 | 1/2018 | Beno et al. |

OTHER PUBLICATIONS

Hitzel, Ronald et al., "Retrofitting Steam Turbines with Modern Control Platforms," Siemens Westinghouse, Dec. 2003, retrieved from <https://webcache.googleusercontent.com/search?q=cache:NuxvnjzwmEQJ:https://www.researchgate.net/profile/Prem_Baboo/post/Is_the_governor_control_system_of_steam_turbine_a_multivariable_system/attachment/59d62aef79197b8077989546/AS%253A341214462267396%25401 >.

Li, Jichao et al., "Automatic efficiency optimization of an axial compressor with adjustable inlet guide vanes," Journal of Thermal Science vol. 21, No. 2, Mar. 10, 2012, retrieved from <https://link.springer.com/article/10.1007/s11630-012-0526-5>.

* cited by examiner

SYSTEMS AND METHODS FOR ADAPTING COMPRESSOR CONTROLLER BASED ON FIELD CONDITIONS

CROSS-REFERENCE TO RELATED APPLICATION

This application claims priority under 35 U.S.C. § 119, based on U.S. Provisional Patent Application No. 62/801,759 filed Feb. 6, 2019, titled "Systems and Methods for Adapting Compressor Controller Based on Field Conditions," the disclosure of which is hereby, incorporated by reference.

BACKGROUND OF THE INVENTION

Compressor surge of axial and centrifugal turbocompressors can lead to compressor damage. Surge may be considered an event where the compressor can no longer maintain an adequate pressure difference to continue forward flow and a bulk flow reversal occurs.

Flow reversal of surge can result in an increase in temperature within the compressor. At the same time, the reversed flow and pressure variations between the intake and discharge ends of the compressor cause rapid changes in axial thrust, thereby risking damage to the thrust bearing and causing blades or vanes to rub on the compressor housing. Furthermore, abrupt speed changes may occur, possibly resulting in overspeed or underspeed of the compressor rotor.

An antisurge controller is used to protect a compressor from surge by continuously monitoring the difference between the compressor's operating point and its surge limit line. Generally, the antisurge controller modulates a recycle or blow-off valve to prevent the compressor's operating point from reaching the surge limit while maintaining other process variables within safe or acceptable limits.

Compressor performance is a function of antisurge performance and other elements, such as speed, process capacity, and interactions between other turbomachines and drivers. Many of these elements are managed with a controller connected to a control valve and actuator.

DETAILED DESCRIPTION OF THE PREFERRED EMBODIMENTS

The following detailed description refers to the accompanying drawings. The same reference numbers in different drawings may identify the same or similar elements.

Systems and methods described herein relate generally to an automatic control scheme for protecting a turbocompressor from surge. More particularly, implementations described herein relate to methods and systems for optimizing the surge control curve of a turbocompressor based on the current conditions and capabilities of the field devices that monitor and adjust or control the system.

While the examples provided are based on antisurge control, the invention applies to other elements of turbomachinery control including, but not limited to, speed control, capacity control, quench control, driver control, sequencing, and control across multiple turbomachines.

To prevent surge, a turbocompressor is typically operated at levels far removed from the turbocompressor's calculated surge line. However, operating conditions may require the compressor to operate near or beyond the surge line. An antisurge controller is employed to recirculate flow and move the compressor away from the calculated surge line; however, this uses energy to recirculate the gas in a non-productive cycle. Minimizing the amount of recirculation is desirable to reduce energy consumption. Thus, antisurge systems are needed that allow the turbocompressor to operate more efficiently and that expand the operating conditions over which the turbocompressor can be safely used.

Systems and methods described herein utilize data, functional capabilities, and information from smart field devices to automatically adjust a control algorithm to optimize control performance on turbomachinery. A control system (e.g. an antisurge controller) polls various field devices, such as control valves, actuators, and process transmitters, for status information. Upon receiving conditions of the field devices, the control system adjusts its parameters and/or operating mode(s) to either take advantage of the field device's capabilities or to fall back to a more conservative control strategy.

Figure 1:
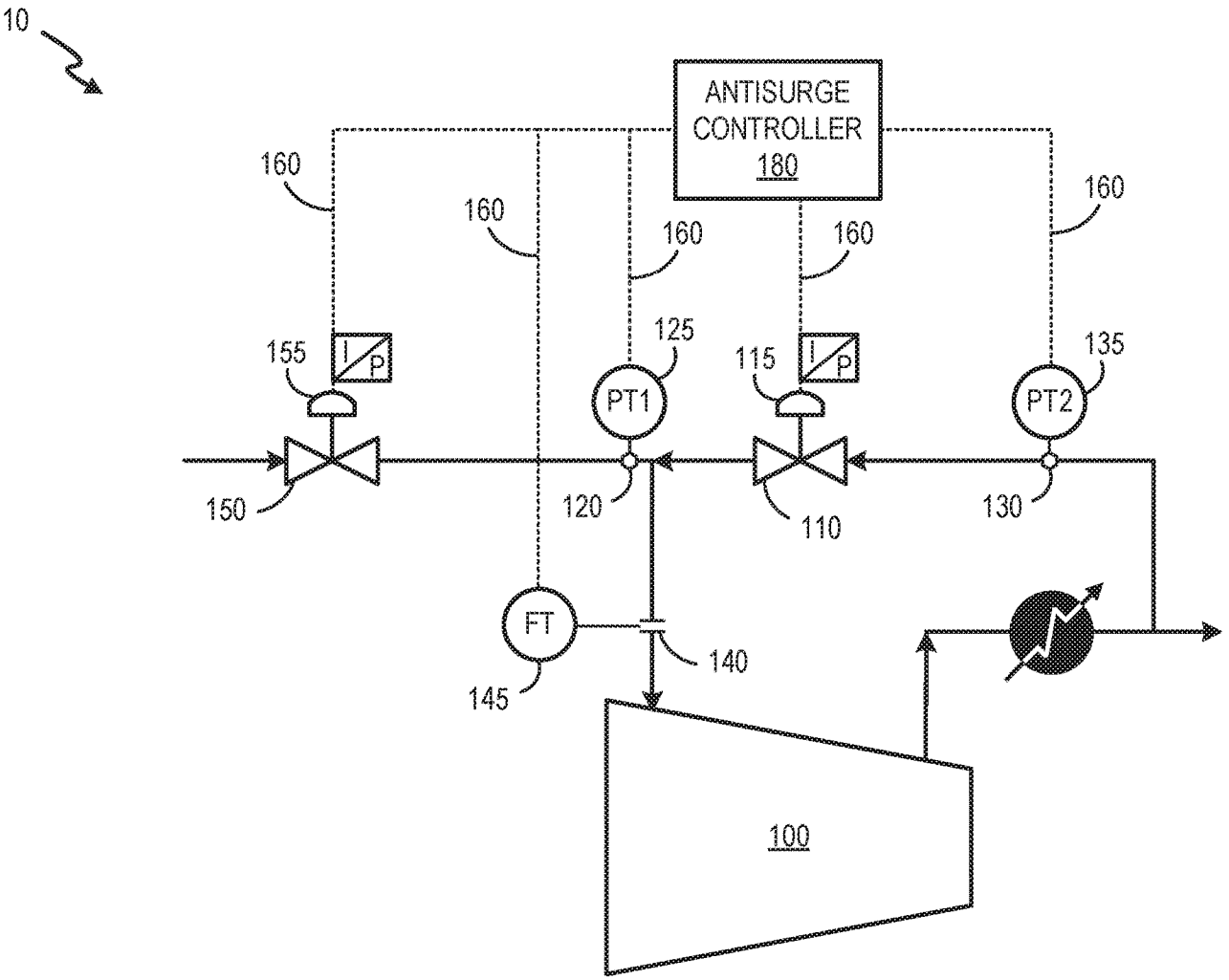
FIG. 1 is a schematic of a system in which systems and methods described herein may, be implemented.

FIG. 1 is a schematic of a turbocompressor system 10 in which systems and methods described herein may be implemented. As shown in FIG. 1, system 10 includes a compressor 100 (also referred to herein as turbocompressor 100) with an antisurge valve 110 connected to an actuator 115. Antisurge controller 180 may set a valve position for antisurge valve 110 by sending a signal to actuator 115. A current-to-pressure transducer (I/P), for example, may convert an analog signal from antisurge controller 180 into a pressure value for actuator 115 to move antisurge valve 110. In the configuration of FIG. 1, antisurge valve 180 is positioned as a recycle valve. In other implementation, antisurge valve 180 may be positioned as a blow-off valve, as might be used for air, nitrogen, and sometimes $CO_2$ compressors. An inlet valve 150 may control gas flow to compressor 100. Similar to antisurge valve 110, a valve position for inlet valve 150 may be set by antisurge controller 180 by sending a signal to actuator 155.

Process feedback for compressor 100, collected from multiple sensors, may be provided to antisurge controller 180. Sensors may include a suction pressure sensor 120, a discharge pressure sensor 130, and a flow meter 140. A suction pressure transmitter 125 collects and transmits data from suction pressure sensor 120. A discharge pressure transmitter 135 collects and transmits data from discharge pressure sensor 130. A flow transmitter 145 collects and transmits data from flow meter 140. In one implementation, actuators 115 and 155 may, provide status information, such as a position feedback signal and/or valve diagnostic data.

Each of antisurge valve 110, actuator 115, suction pressure sensor 120, suction pressure transmitter 125, discharge pressure sensor 130, discharge pressure transmitter 135, flow meter 140, flow transmitter 145, inlet valve 150, and actuator 155 may be referred to herein collectively and generically as "field devices."

Signals from actuator 115, suction pressure transmitter 125, discharge pressure transmitter 135, flow transmitter 145, and actuator 155 may be sent to antisurge controller 1813. Antisurge controller 180 may analyze signals from actuator 115, suction pressure transmitter 125, discharge pressure transmitter 135, flow transmitter 145, and actuator 155 and calculate a closed loop response to, for example, a corresponding position for antisurge valve 110.

As further illustrated, system 10 includes communicative links 160 between antisurge controller 180 and each of the field devices. A field device may transmit and receive data via link 160. System 10 may be implemented to include wireless (e.g., radio frequency) and/or wired (e.g., electrical, optical, etc.) links 160. A communication connection between antisurge controller 180 and the field devices may be direct or indirect. For example, an indirect communication connection may involve an intermediary device not illustrated in FIG. 1. Additionally, the number, the type (e.g., wired, wireless, etc.), and the arrangement of links 160 illustrated in system 10 are exemplary.

Modern field devices (also referred to as smart devices), such as those used in system 10, have functional capabilities, generate additional data, and perform diagnostics beyond the basic pressure sensors, flow sensors, and/or temperature sensors provided by older legacy devices. For example, field devices of system 10 may have the capability to self-detect degradation, monitor response times, track calibration expiration periods, signal sensor drift, indicate valve movement speeds, predict response times, report precise valve positions, etc.

Under normal operating conditions for compressor 100, antisurge controller 180 collects thermodynamic information taken at the inlet and outlet of the compressor 100. This information typically comprises at least a pressure differential signal obtained from flow meter 140 and transmitted by flow transmitter 145; a suction pressure signal, measured by suction pressure sensor 120 and transmitted by suction pressure transmitter 125; and a discharge pressure signal, measured by discharge pressure sensor 130 and transmitted by discharge pressure transmitter 135. These signals are fed to antisurge controller 180 where the signals are analyzed and a closed loop response is calculated based on a particular control algorithm for the turbocompressor system. This closed loop response determines, for example, the set point of an antisurge valve 110. Signals representing other thermodynamic data, such as one or more temperatures, may also be used by antisurge controller 180. Mechanical parameters such as compressor rotational speed, inlet guide vane position, or discharge guide vane position may also be measured and transmitted to the antisurge controller 180.

Figure 2:
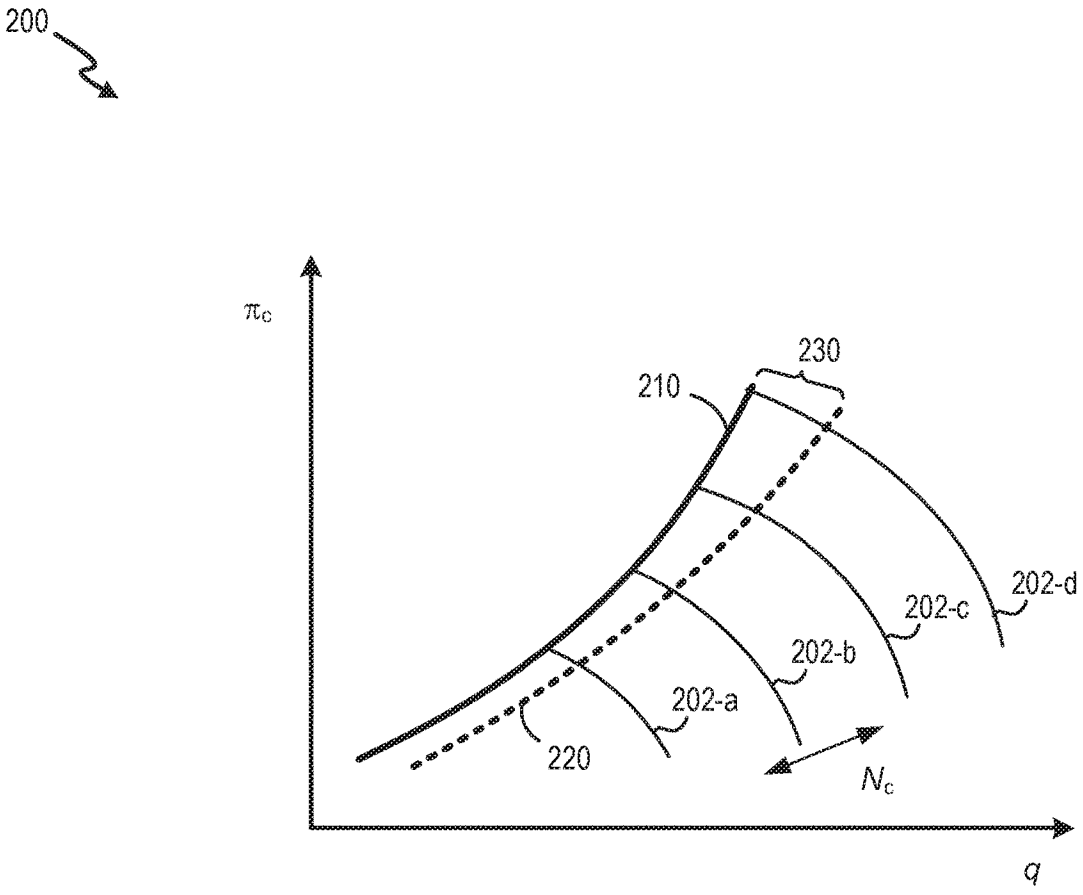
FIG. 2 is a representative compressor map showing a surge limit and a surge control curve.

To prevent surge and corresponding fatigue failures over time, compressor 100 is operated at levels below a calculated surge point for a given operational speed. FIG. 2 illustrates a representative compressor performance map 200, commonly referred to as a compressor map. The abscissa and ordinate variables are preferably dimensionless parameters or derived from dimensionless parameters. The abscissa variable, q, is frequently related to the flow rate through compressor 100. The ordinate variable, $\pi_c$, is frequently a static pressure ratio or related to a mass specific energy added to the compressed fluid. Other possible coordinate systems may be used.

The individual curves 202 with non-positive slopes (e.g., curves 202-*a* through 202-*d*) in FIG. 2 are performance curves at different compressor rotational speeds. Each performance curve 202 is for a different value of corrected speed, $N_c$, which is a function of the compressor rotational speed, N. The left-most curve is a surge limit curve 210 for compressor 100 (also referred to as a surge limit line, or simply surge limit). The area located to the left of and above surge limit curve 210 corresponds to a situation in which the operation of compressor 100 is unstable, and is characterized by periodic reversals of flow direction (i.e., surge). The actual surge limit curve may be determined theoretically and/or empirically and may be based on the particular implementation in which compressor 100 operates. In any event, the position of surge limit curve 210 is used in designing an antisurge control system for compressor 100. The other curve having a positive slope in FIG. 2 is a surge control curve 220 (or surge control line). Surge control curve 220 is displaced toward the stable operating region from the surge limit (i.e., to the right of and below surge limit curve 210) by a safety margin 230.

Surge control curve 220 is defined by an antisurge control system designer or field engineer based on experience or tests. For example, surge control curve 220 may apply a desired safety factor reflected in margin 230. The size of margin 230 may account for a number of variables of field devices in system 10, such as response times, signal delays, calibration accuracy, equipment degradation, etc. Generally, in conventional antisurge systems, margin 230 represents a fixed amount between surge limit curve 210 and surge control curve 220 along any of performance curves 202. That is, margin 230 may provide a known level of inefficiency in exchange for assured antisurge control. According to systems and methods described herein, antisurge controller 180 may dynamically adjust the surge control curve (and the corresponding margin 230) based on capability feedback from field devices in system 10.

Figure 3:
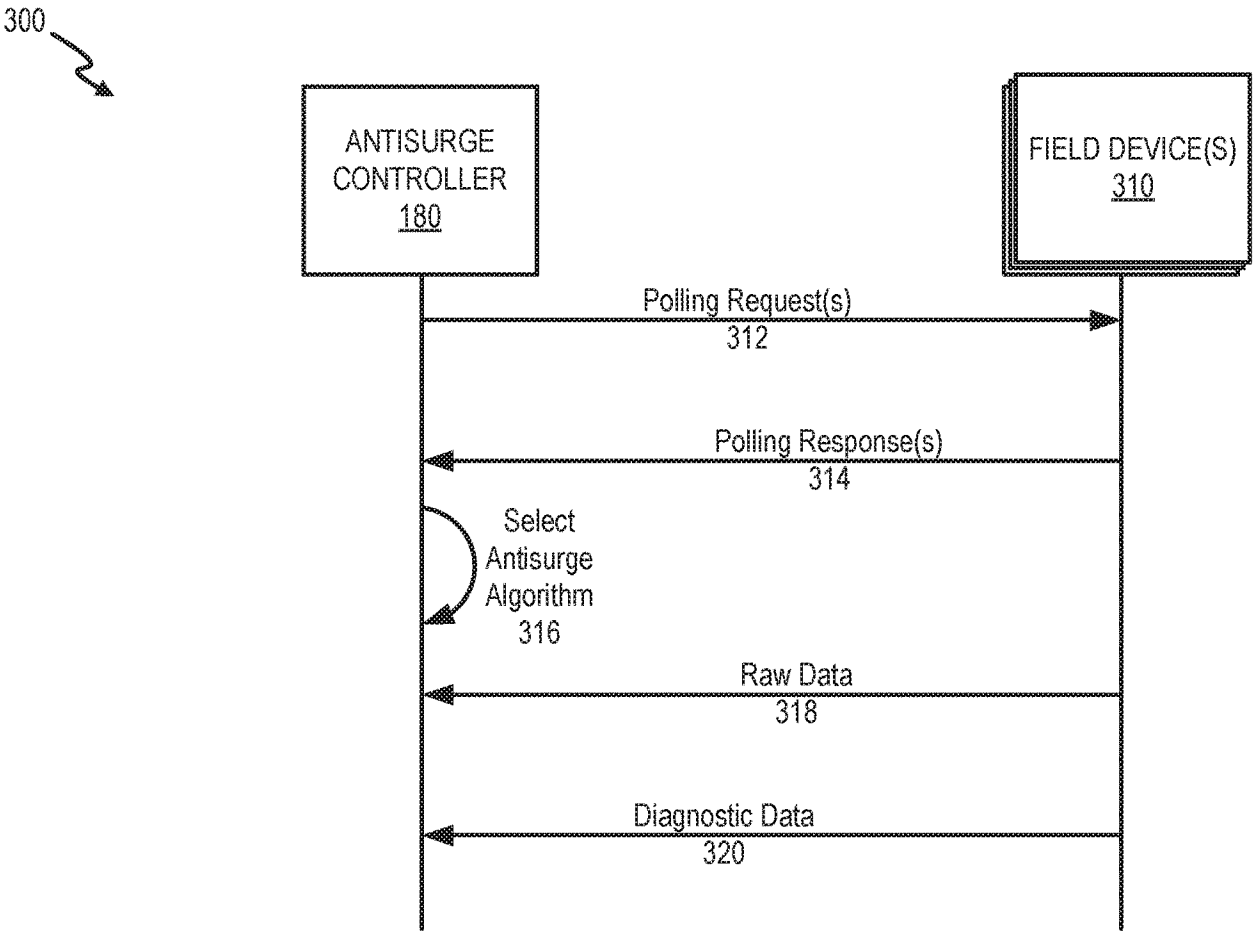
FIG. 3 is a diagram of exemplary communications between the antisurge controller and a field device of FIG. 1.

FIG. 3 is a diagram of exemplary communications for dynamically optimizing an antisurge algorithm. Communications in FIG. 3 may occur between antisurge controller 180 and field devices 310 within a portion 300 of system 10. Each of field devices 310 may correspond to any one of the field devices of system 10. Antisurge controller 180 may communicate with field devices 310 via links 160. Communications shown in FIG. 3 provide simplified illustrations of communications in network portion 300 and are not intended to reflect every signal or communication exchanged between devices.

As shown in FIG. 3, antisurge controller 180 may send a polling request 312 to field device 310. Generally, polling request 312 may induce field device 310 to provide a capability or status of the field device. For example, polling request 312 may request a particular type of data, a configuration file, or a status report, etc. In one implementation, polling request 312 may include capability feedback, such as a file or list of capabilities for field devices 310. In one implementation, polling request 312 may be provided on a periodic basis. Additionally, or alternatively, polling request 312 may be triggered when antisurge controller 180 detects an anomaly in process feedback data received (or not received) from one or more of field devices 310.

Field device 310 may receive polling request 312 and provide a polling response 314 to antisurge controller 180.

In one implementation, polling response 314 may indicate a status or a capability of field device 310. Different types of field devices 310 may have different capabilities, such as capabilities to provide different types of data. Field devices 310 may provide "capability feedback" to indicate the capabilities of each field device (e.g., types of parameters the field device can support). Field devices 310 may also provide "process feedback" that provides the actual monitoring data for system 10 during operation. For example, polling response 314 may include capability feedback, such as a file or list of capabilities of field devices 310. In another implementation, polling response 314 may include monitoring data (e.g., process feedback) that is indicative of a capability of field device 310 to perform a particular function.

Antisurge controller 180 may receive polling response 314 and select 316 an appropriate antisurge algorithm (also referred to as a surge control algorithm) that is optimized for the collective capabilities of field devices 310. For example, if polling responses 314 indicate a full suite of smart field devices programmable devices) with no degradation with respect to operating capabilities and self-diagnostic capabilities, antisurge controller 180 may select an antisurge algorithm that incorporates advanced feedback features to operate with lower margins. As another example, if polling responses 314 indicate that one or more of field devices 310 have significant degradation, antisurge controller 180 may select an antisurge algorithm that excludes the degraded field device 310 and provides comparatively larger margins.

Field devices 310 may also provide raw data 318 and/or diagnostic data 320 to antisurge controller 180. Raw data 318 may include, for example, sensor data, position data, or other data directly from sensors. Diagnostic data 320 may include pre-diagnosed data that indicates a particular condition (e.g., high pressure, valve degradation, calibration certificate expiration, etc.). Depending on the currently-selected antisurge algorithm 316, antisurge controller 180 may apply relevant raw data 318 and diagnostic data 320 to perform antisurge control for system 10. In one implementation, raw data 318 and/or diagnostic data 320 that are not relevant for the currently-selected antisurge algorithm 316 may be logged and/or discarded by antisurge controller 180.

Figure 4:
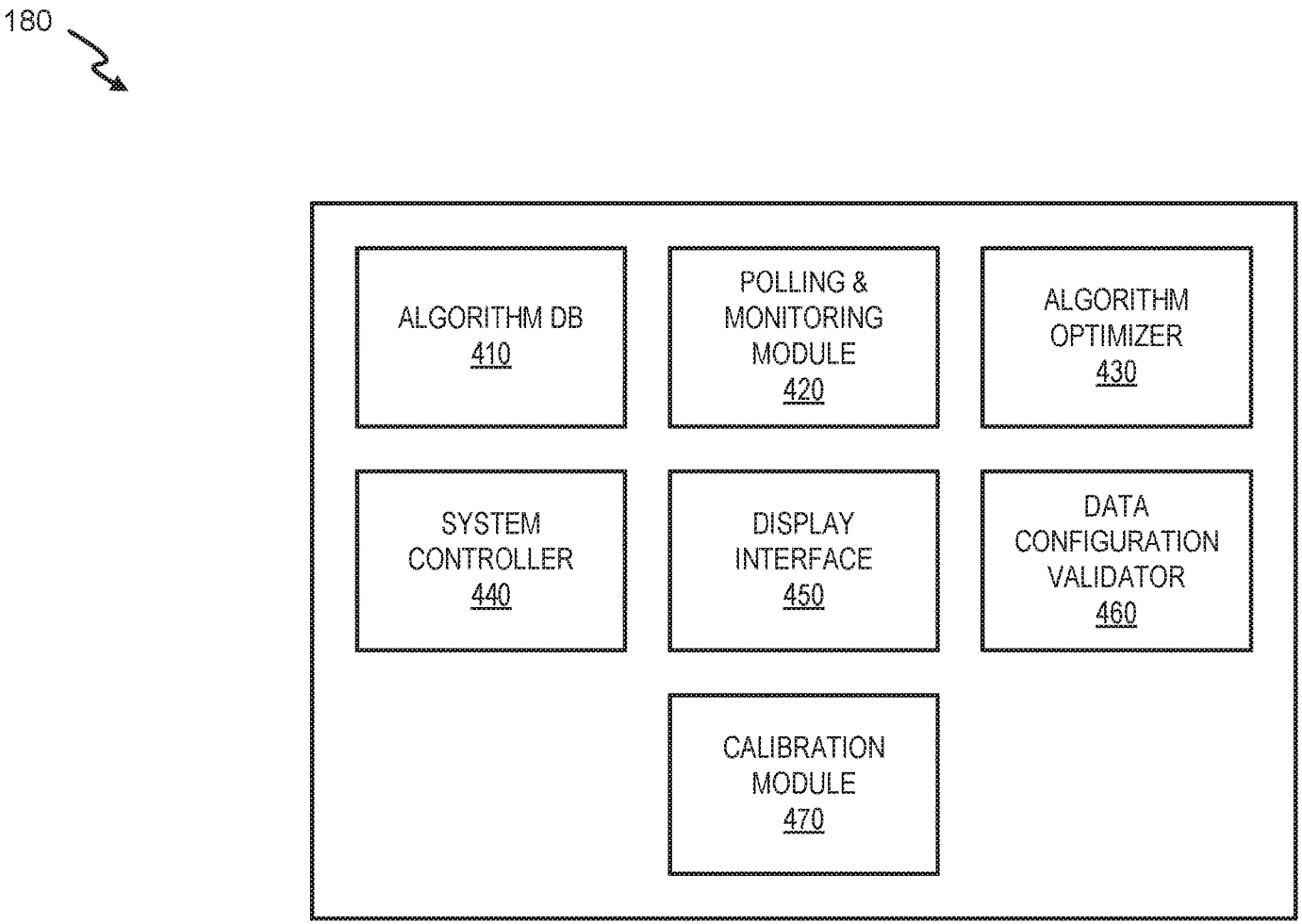
FIG. 4 is a block diagram of logical components of the antisurge controller of FIG. 1.

FIG. 4 is a block diagram illustrating exemplary logical components of antisurge controller 180 according to an implementation described herein. The functional components of antisurge controller 180 may be implemented, for example, via a processor (e.g., processor 820 of FIG. 8) executing instructions from memory 230 (memory 830 of FIG. 8) or via hardware. As shown in FIG. 4, antisurge controller 180 may include an algorithm database 410, a polling and monitoring module 420, an algorithm optimizer 430, a system controller 440, a display interface 450, a data configuration validator 460, and a calibration module 470.

Algorithm database 410 may store different antisurge algorithms or different components of antisurge algorithms that may apply when different combinations of feedback parameters are available in system 10. The different antisurge algorithms may correspond to different control strategies, which may provide for different margins. For example, some antisurge algorithms in algorithm database 410 may incorporate advanced parameters from field devices 310, such as actuator response times, valve movement times, valve erosion, stiction, temperature, non-responsive or missing process variables, or other field device variables. Application of these advanced parameters may allow antisurge controller 180 to maintain system 10 at operating levels closer to process limits (e.g., surge limit curve 210) than typically used. Conversely, other antisurge algorithms in algorithm database 410 may rely on fewer/different parameters and provide a more conservative control strategy (e.g., with larger margins). In still other implementations, antisurge algorithms in algorithm database 410 may account for failed sensor components or the ability of field devices 310 to provide flags (e.g., diagnostic data 320) to quickly detect and respond to system conditions.

Polling and monitoring module 420 may provide polling requests (e.g., polling requests 312) to field devices 310 and process polling responses (e.g., polling responses 314). According to one implementation, polling and monitoring module 420 may generate different types of polling requests for different types field devices 310. For example, a polling request 312 to pressure transmitter 135 may be provided in a different format and/or request different information than another polling request 312 to actuator 115. In one implementation, polling and monitoring module 420 may compile and store a list of parameters currently available from each field device 310 in system 10. In one implementation, polling and monitoring module 420 may convert capability feedback from different field devices 310 in different formats into a unified format for use by algorithm optimizer 430.

According to one implementation, polling and monitoring module 420 may perform periodic polling of all field devices 310. Additionally, or alternatively, polling and monitoring module 420 may monitor for periodic capability feedback from field devices 310. Furthermore, polling and monitoring module 420 may issue a polling request if data anomalies (such as missing data or distorted data) are detected in process feedback from field devices 310.

Algorithm optimizer 430 may identify currently available parameters of field devices 310 (e.g., from polling and monitoring module 420) and select an algorithm from algorithm database 410) for controlling surge in system 10. In one implementation, algorithm optimizer 430 may perform a selection process to identify an algorithm that can be supported using the currently available parameters while allowing system 10 to operate closest to process limits (e.g., the smallest safety or surge control margin). According to another implementation, algorithm optimizer 430 may apply a control algorithm that takes advantage of fast actuator response times and valve movement performance in field devices 310 to avoid rundown surge. For example, when compressor 100 is forced into an emergency stop, rundown surge can be avoided if certain valves are opened (e.g., a blow-off valve) and closed (e.g., a discharge check valve) sequentially within a short time period (e.g., fractions of a second) after an emergency stop. Thus, algorithm optimizer 430 may automatically invoke an algorithm to prevent rundown surge when currently available parameters of field devices 310 meet required valve response times to support such an algorithm.

System controller 440 may implement the algorithm selected by algorithm optimizer 430. For example, system controller 440 may apply the selected control algorithm to monitor process feedback from field devices 310 and adjust antisurge valve 110, for example, to maintain selected process margins 230.

Display interface 450 may display high-resolution and high-speed data analysis from one or more field devices 310 in system 10. For example, some field devices 310 may have diagnostic data (e.g., diagnostic data 320) that is scanned and monitored within the particular field device 310. Display interface 450 may receive the diagnostic data from individual field devices 310 and incorporate the diagnostic data into a system interface, such as user interface 500 described below.

Data configuration validator 460 may compare the data configuration of antisurge controller 180 with data configurations from field devices 310 to confirm, for example, proper configuration of data in antisurge controller 180 so that data fields from the field devices 310 and antisurge controller 180 align. Data configuration that can be validated may include data field types, field orders, field formats, etc. For example, data configuration validator 460 may receive field device data from polling and monitoring module 420. Data configuration validator 460 may confirm that data formats from field devices 310 match data formats used, for example, in algorithms of algorithm database 410 and/or display interface 450. Additionally, or alternatively, data configuration validator 460 may use information polled from field devices 310 to verify data configuration or automatically set configuration parameters of antisurge controller 180.

As one non-limiting illustration of the role of data configuration validator 460, assume antisurge controller 180 and a field device 310 (e.g., actuator 115) use Modbus serial communications protocol with RS-485 connection standards for communicative link 160. Antisurge controller 180 and actuator 115 must agree on what data resides in a particular field (e.g., field 40002), how many bits are used in the field (2, 8, 16 bits, etc.), whether big or little endian byte orders are used, whether the data includes stop bits, etc. if the data link layer for the communication interface between antisurge controller 180 and actuator 115 aligns on both ends of communicative link 160, the two devices can communicate properly. But if antisurge controller 180 is configured with the particular field (e.g., 40002) as the "commanded position" and actuator 115 uses the "actual position" for the same field, the data will look correct to antisurge controller 180 but cause antisurge controller 180 to control actuator 115 in an improper fashion. Thus, system 10 may use pre-configured setups for each actuator 115/155, and data configuration validator 460 may verify the readings of each actuator 115/155 (in the event someone alters the configuration) to ensure optimal operation.

According to one implementation, data configuration validator 460 may automatically update configuration of data in antisurge controller 180 to match configurations provided by field devices 310. In another implementation, data configuration validator 460 may generate an alert signal upon detecting a discrepancy between data configurations in antisurge controller 180 and data configurations provided by field devices 310.

Calibration module 470 may initiate an automatic calibration procedure for a field device 310, such as actuator 115. For example, calibration module 470 may calibrate actuator 115 based on control response parameters. In one implementation, calibration module 470 may invoke a calibration algorithm of the actuator 115 to set certain parameters of the actuator. Some examples of actuator parameters that need to be set and can be critical to system 10 operation include: gain, deadband, low travel cutoff, maximum speed, span distance, normal or reverse acting, and ramp time. Not all types (e.g., different brands/models) of actuator 115 have all of these parameters, and there are numerous other parameters that can be set. The parameters may vary based on the motive force (e.g., electric, hydraulic, pneumatic) used by actuator 115 and manufacturer preferences. Thus, calibration module 470 may store pre-configured parameters and calibration procedures for different types of field devices 310.

Although FIG. 4 shows exemplary logical components of antisurge controller 180, in other implementations, antisurge controller 180 may include fewer logical components, different logical components, or additional logical components than depicted in FIG. 4. Additionally or alternatively, one or more logical components of antisurge controller 180 may perform functions described as being performed by one or more other logical components.

Figure 5:
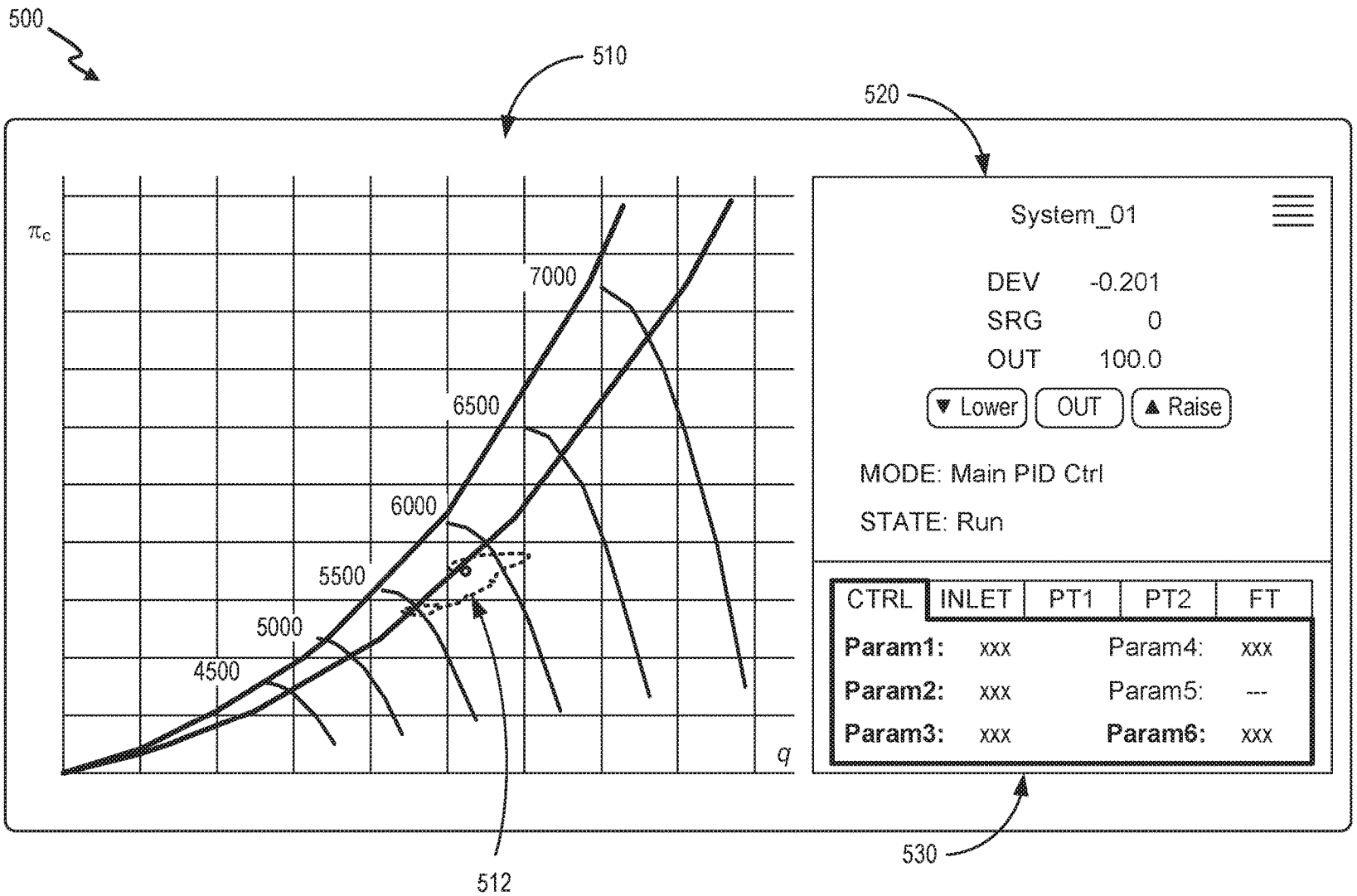
FIG. 5 is an example of a user interface for a turbocompressor system according to an implementation described herein.

FIG. 5 is an example user interface 500 that may be generated by display interface 450. As shown in FIG. 5, user interface 500 may include a system graph 510, a system control pallet 520, and field device parameter readings 530.

System graph 510 may include a surge limit curve, a surge control curve, and performance curves for particular system 10. In one implementation, system graph 510 may include a visual log 512 of historical performance of the system.

System control pallet 520 may include operation status indications and control settings for system 10. In one implementation, system control pallet 520 may include multiple menus and user-defined configurations.

Field device parameter readings 530 may include a list of parameters available to be used with each field device 310 in system 10. Parameters in field device parameter readings 530 may correspond to capabilities of different field devices 310. For example, parameters listed in field device parameter readings 530 may include parameters corresponding to field device 310 capabilities detected by polling and monitoring module 420. In one implementation, parameters displayed in field device parameter readings 530 may be shown in different colors or sizes depending on whether or not the parameters are currently being used for a current antisurge algorithm (e.g., as selected by algorithm optimizer 430).

Although user interface 500 depicts a variety of information, in other implementations, user interface 500 may depict less information, additional information, different information, or differently arranged information than depicted in FIG. 5.

Figure 6:
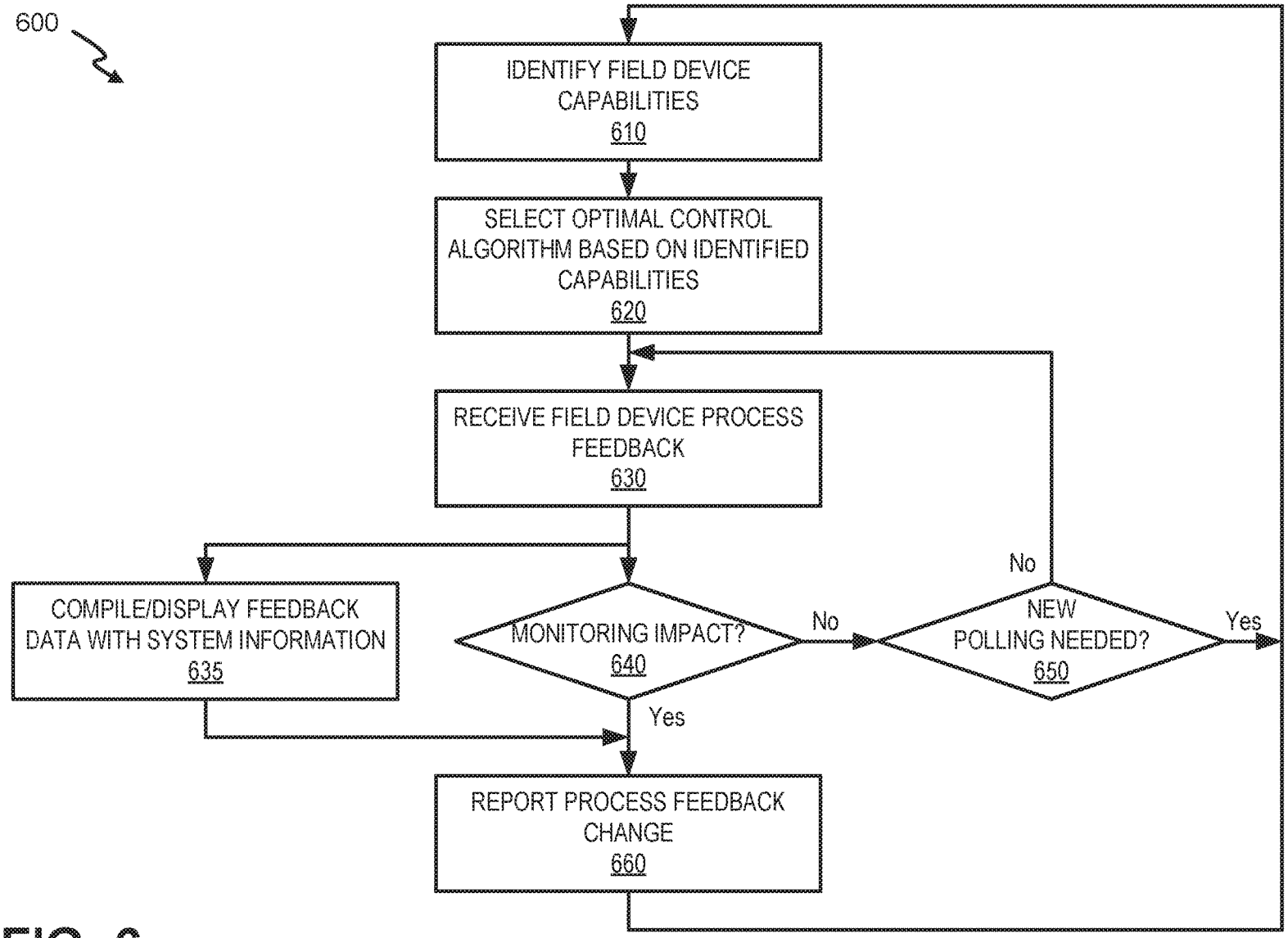
FIG. 6 is a process flow diagram for adapting an antisurge controller to optimize operating conditions based on field device capabilities, according to an implementation.

FIG. 6 is a flow diagram of a process 600 for dynamically adapting an antisurge controller to optimize operating conditions based on field device capabilities. According to one implementation, process 600 may be performed by antisurge controller 180. In another implementation, process 600 may be performed by antisurge controller 180 in conjunction with field devices 310.

As shown in FIG. 6, process 600 may include identifying field device capabilities for a turbocompressor system (block 610). For example, according to one implementation, antisurge controller 180 may poll field devices 310 for capabilities. In another implementation, capabilities of field devices 310 may be determined by antisurge controller 180 based on periodic reports or based on the types of process feedback data provided to antisurge controller 180 by field devices 310. Basic capabilities may include, for example, detection of pressure, temperature, flow, and current. More advanced capabilities may include, for example, valve diagnostics, response times (for valves and/or sensors), valve movement times, valve position indications, etc.

Process 600 may also include selecting an optimal control algorithm based on the identified capabilities (block 620) and receiving field device feedback data (block 630). For example, antisurge controller 180 may select an algorithm (e.g., from algorithm database 410) for controlling surge in system 10. In one implementation, antisurge controller 180 may select an algorithm that provides the smallest surge control margin using the currently-available parameters. Additionally, or alternatively, antisurge controller 180 may select an algorithm to prevent rundown surge, as described above. Antisurge controller 180 may receive feedback data for system 10 from field devices 310. Feedback data may include sensor data (e.g., raw data 318 from suction pressure transmitter 125, discharge pressure transmitter 135, flow transmitter 145, etc. valve position data (e.g., raw data 318 from antisurge valve 110, inlet valve 150, etc.), and/or diagnostic flags (e.g., diagnostic data 320).

Process 600 may further include compiling and/or displaying the feedback data with system information (block 635), and determining if the feedback data has a monitoring impact (block 640). For example, antisurge controller 180 may receive raw data 318 and/or diagnostic data 320 from field devices 310. Antisurge controller 180 may present some or all of raw data 318 and diagnostic data 320 in conjunction with overall system data. In one implementation, display interface 450 of antisurge controller 180 may present raw data 318 and diagnostic data 320 from field devices 310 within real-time user interface 500. Antisurge controller 180 may also inspect and process raw data 318 and diagnostic data 320 to determine if any of raw data 318 and/or diagnostic data 320 indicates an impact on the performance or the implementation of the currently selected control algorithm (e.g., selected in block 620). For example, in one implementation, antisurge controller 180 (e.g., polling and monitoring module 420) may inspect raw data 318 from field devices 310 for missing or distorted data. Additionally, or alternatively, antisurge controller 180 may detect diagnostic data 320 that indicates a particular condition of a field device 310 which would impact the effectiveness of the currently selected control algorithm.

If the feedback data does not indicate any monitoring impact (block 640—No), process 600 may include determining if new polling is needed for the field devices (block 650). For example, antisurge controller 180 may perform periodic polling of field devices 310 to ensure current capabilities of field devices 310 can support the currently selected control algorithm. Thus, antisurge controller 180 may determine if a polling window has expired, triggering a need for a new polling inquiry (e.g., from polling and monitoring module 420).

If new polling is needed for the field devices (block 650—Yes), process 600 may return to block 610 to identify field device capabilities. If new polling is not needed for the field devices (block 650—No), process 600 may return to block 630 and continue to receive field device feedback data.

If the feedback data indicates there is monitoring impact (block 640—Yes), process 600 may include reporting a feedback change (block 660), and returning to block 610 to identify field device capabilities. For example, if any of raw data 318 and/or diagnostic data 320 indicates an impact on the performance or the implementation of the currently selected control algorithm (e.g., selected in block 620), antisurge controller 180 may report the instance (e.g., via user interface 500, a separate electronic notification, an audible signal, etc.). Antisurge controller 180 may also poll field devices 310 for conditions and capabilities of field devices 310.

Based on either the interpretation of raw data 318 and/or diagnostic data 320, or the polling result, antisurge controller 180 may automatically and dynamically adjust parameters (e.g., threshold values for the current control algorithm) and/or operating mode (e.g., changing the control algorithm) to either take advantage of the field devices' capabilities or fall back to a more conservative control strategy. In another implementation, antisurge controller 180 may provide (e.g., via a user interface 500), an alert signal to an operator/engineer indicating the selection of the updated control algorithm. In another implementation, antisurge controller 180 may invoke specialized operating modes of the field device (e.g., dead time on seat, "Quick Track"™, etc.) to take advantage of built-in functions of the field device.

While some portions of the flow diagram in FIG. 6 are represented as a sequential series of blocks, in other implementations, different blocks may be performed in parallel or in series. For example, in one implementation, capability feedback and process feedback may be received from field devices 310 simultaneously or asynchronously.

Figure 7:
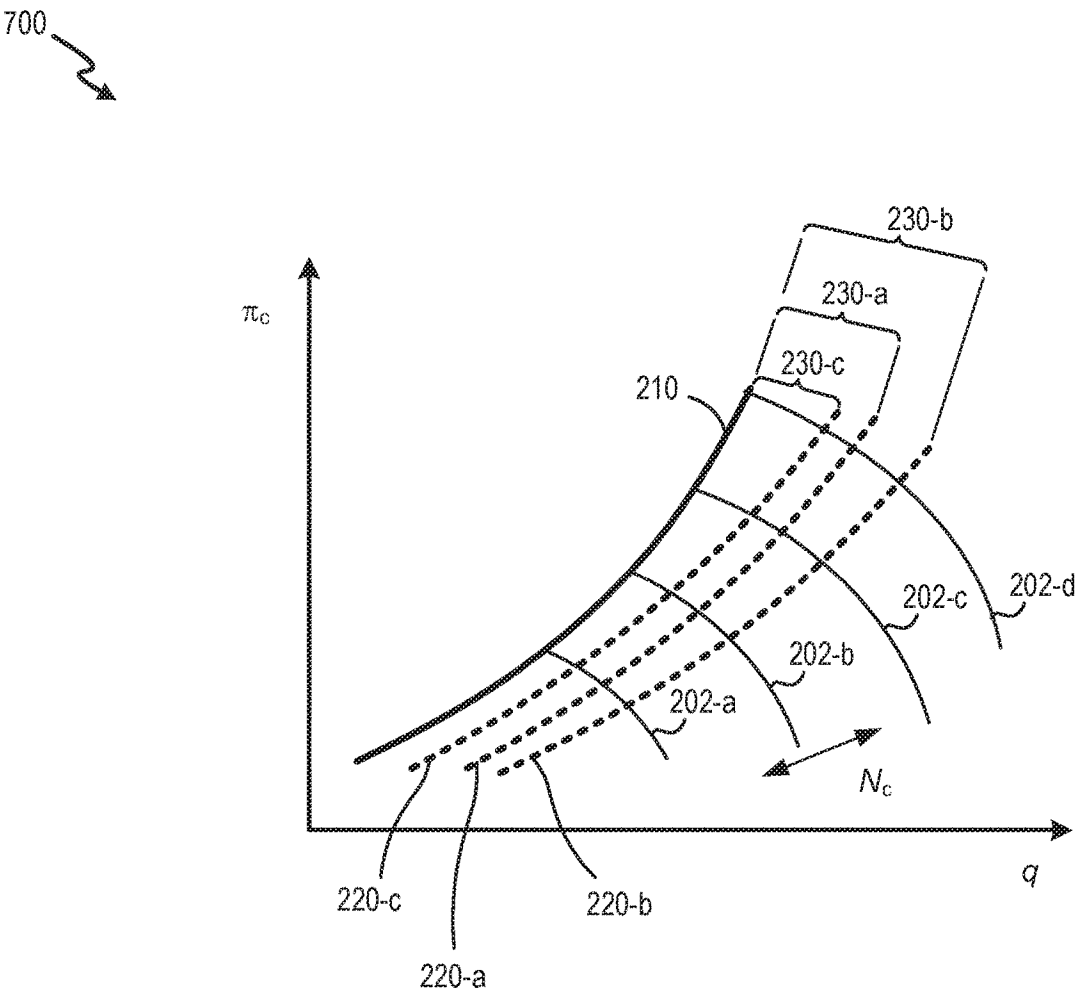
FIG. 7 is a representative compressor performance map showing dynamic selection of control algorithms to support different surge control curves.

FIG. 7 illustrates a representative compressor performance map 700 showing dynamic selection of control algorithms to support different surge control curves 220. According to an implementation, antisurge controller 180 may dynamically change antisurge algorithms to enforce different surge control curves 220 (e.g., surge control curve 220-*a*, 220-*b*, 220-*c*). The different surge control curves 220 provide different margins 230 (e.g., margins 230-*a*, 230-*b*, 230-*c*).

As shown in FIG. 7, surge limit curve 210 represents the limits of stable operation for compressor 100. After polling field devices 310 for conditions and capabilities of field devices 310, antisurge controller 180 may identify advanced features of one or more field devices 310 that permit use of a control algorithm to implement surge control curve 220-*a* with a relatively small margin 230-*a*.

Assume that antisurge controller 180 receives capability feedback from one of field devices 310 indicting a condition that may cause delayed response or inaccurate data. For example, a valve (e.g., antisurge valve 110) may detect and report (e.g. via diagnostic data 320) stiction of a valve stem. Until a physical correction of antisurge valve 110 can be performed, the stiction may require a control signal to overshoot a desired set point in order to initiate any valve movement. In response to the stiction indication (and regardless of the actual operating conditions of system 10), antisurge controller 180 may dynamically change the control algorithm parameters to implement surge control curve 220-*b* with a relatively larger margin 230-*b*.

In another example, a pressure sensor discharge pressure transmitter 135) may detect and report pressure sensor drift. In still another example, a valve (e.g., antisurge valve 110) may detect and report erosion of a valve seat. In further example, one of field devices 310 may detect that a calibration certification has expired (implying readings from the particular field device 310 may no longer be reliable). According to implementations described herein, upon detecting failure or degradation in a field device 310, antisurge controller 180 may fall back to more conservative para e s (e.g., to implement a surge control curve 220 with a relatively, larger margins 230) or switch to a more conservative control algorithm that does not rely on capabilities of field devices 310 that may provide delayed or inaccurate data.

Still referring to FIG. 7, assume a field device 310 is serviced or upgraded. For example, a valve actuator (e.g., valve actuator 115) may be upgraded to provide faster response times than previously used in system 10. As another example, a valve (e.g., antisurge valve 110) may be upgraded to provide faster movement/adjustment speeds. As still another example, a field device 310 may be re-calibrated. Antisurge controller 180 may poll the field devices 310 and identify the upgraded features. Antisurge controller 180 may identify the new or verified capabilities of field devices 310 and select an algorithm that provides the smallest surge control margin supported by the available field device capabilities. As shown in FIG. 7, antisurge controller 180 may change to a control algorithm to implement surge control curve 220-*c* with a smallest margin 230-*c*.

Figure 8:
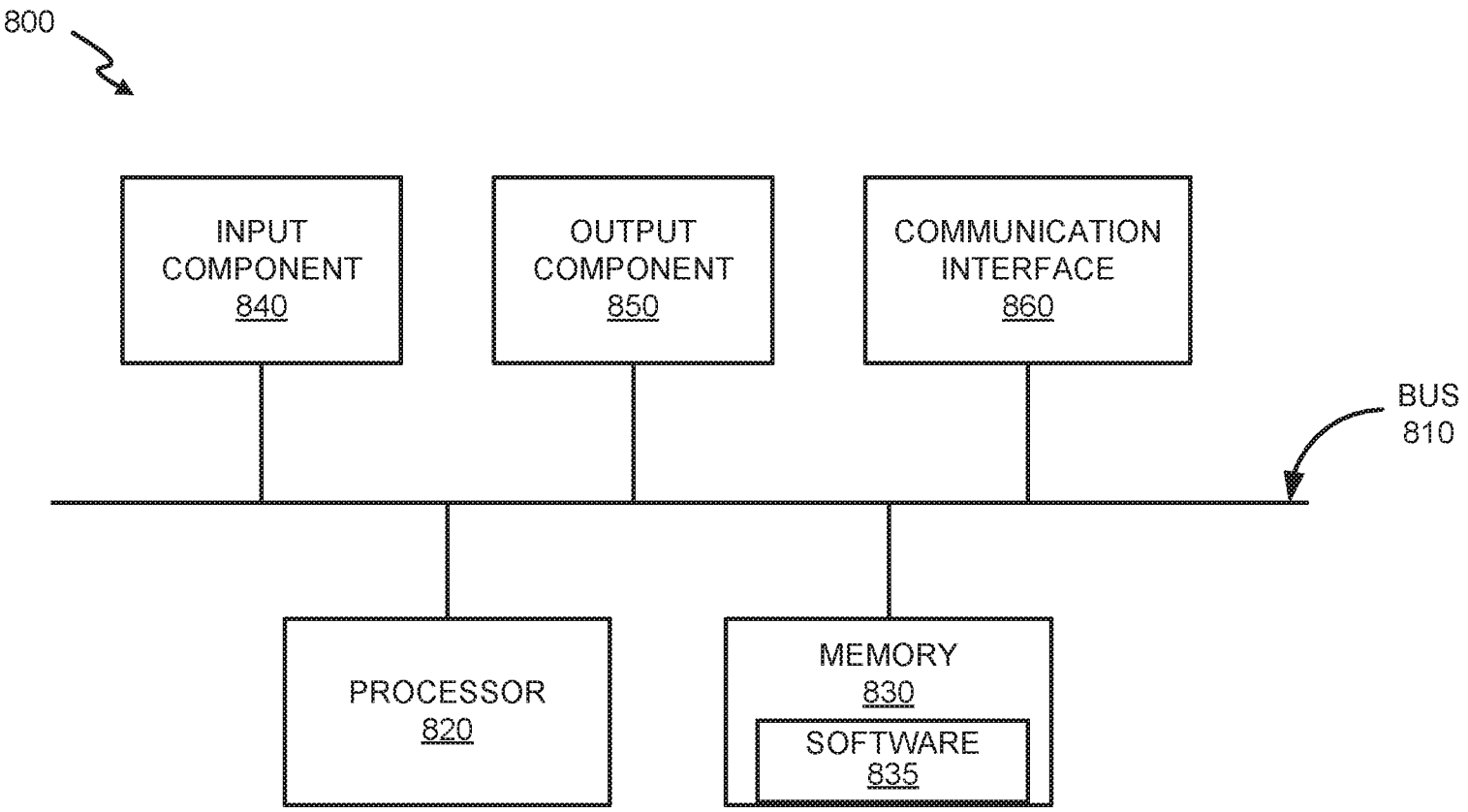
FIG. 8 is a diagram illustrating exemplary physical components of the antisurge controller of FIG. 1.

FIG. 8 is a diagram illustrating exemplary physical components of antisurge controller 180. Antisurge controller 180 may include a bus 810, a processor 820, a memory 810, an input component 840, an output component 850, and a communication interface 860.

Bus 810 may include a path that permits communication among the components of antisurge controller 180. Processor 820 may include a processor, a microprocessor, or processing logic that may interpret and execute instructions. Memory 830 may include any type of dynamic storage device that may store information and instructions (e.g., software 835), for execution by processor 820, and/or any type of non-volatile storage device that may store information for use by processor 820.

Software 835 includes an application or a program that provides a function and/or a process. Software 835 is also intended to include firmware, middleware, microcode, hardware description language (HDL), and/or other form of instruction.

Input component 840 may include a mechanism that permits a user to input information to antisurge controller 180, such as a keyboard, a keypad, a button, a switch, a touch screen, etc. Output component 850 may include a mechanism that outputs information to the user, such as a display, a speaker, one or more light emitting diodes (LEDs), etc.

Communication interface 860 may include a transceiver that enables antisurge controller 180 to communicate with other devices and/or systems via wireless communications (e.g., radio frequency communications), wired communications, or a combination of wireless and wired communications. For example, communication interface 860 may include mechanisms for communicating with another device or system, such as suction pressure transmitter 125, discharge pressure transmitter 135, and flow transmitter 145, via a network, or to other devices/systems, such as a system control computer that monitors operation of multiple systems 10 (e.g., in a steam plant or another type of plant). In one implementation, communication interface 860 may be a logical component that includes input and output ports, input and output systems, and/or other input and output components that facilitate the transmission of data to/from other devices.

Antisurge controller 180 may perform certain operations in response to processor 820 executing software instructions (e.g., software 835) contained in a computer-readable medium, such as memory 830. A computer-readable medium may be defined as a non-transitory memory device. A non-transitory memory device may include memory space within a single physical memory device or spread across multiple physical memory devices. The software instructions may be read into memory 830 from another computer-readable medium or from another device. The software instructions contained in memory 830 may cause processor 820 to perform processes described herein. Alternatively, hardwired circuitry may be used in place of or in combination with software instructions to implement processes described herein. Thus, implementations described herein are not limited to any specific combination of hardware circuitry and software.

Antisurge controller 180 may include fewer components, additional components, different components, and/or differently arranged components than those illustrated in FIG. 8. As an example, in some implementations, a display may not be included in antisurge controller 180. In these situations, antisurge controller 180 may be a "headless" device that does not include input component 840 and/or output component 850. As another example, antisurge controller 180 may include one or more switch fabrics instead of, or in addition to, bus 810. Additionally, or alternatively, one or more components of antisurge controller 180 may perform one or more tasks described as being performed by one or more other components of antisurge controller 180.

According to systems and methods described herein, an antisurge controller for a turbocompressor system may store, in a local memory of the antisurge controller, multiple control algorithms. The antisurge controller may identify capabilities of field devices in the turbocompressor system. The field devices include an antisurge valve and multiple sensors. The antisurge controller may select one of the multiple control algorithms based on the identified capabilities and apply the selected control algorithm to the turbocompressor system. In some instances, the selected control algorithm may provide the smallest surge control margin, of the surge control margins in the multiple control algorithms, that are supported by the identified capabilities.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

Although the invention has been described in detail above, it is expressly understood that it will be apparent to persons skilled in the relevant art that the invention may be modified without departing from the spirit of the invention. Various changes of form, design, or arrangement (e.g., use in capacity control, speed control, or other control applications) ray be made to the invention without departing from the spirit and scope of the invention.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

Embodiments described herein may be implemented in many different forms of software executed by hardware. For example, a process or a function may be implemented as "logic," a "component," or an "element." The logic, the component, or the element, may include, for example, hardware (e.g., processor 820, etc.), or a combination of hardware and software (e.g., software 835). Embodiments have been described without reference to the specific software code because the software code can be designed to implement the embodiments based on the description herein and commercially available software design environments and/or languages. For example, various types of programming languages including, for example, a compiled language, an interpreted language, a declarative language, or a procedural language may be implemented.

All structural and functional equivalents to the elements of the various aspects set forth in this disclosure that are known or later come to be known to those of ordinary skill in the art are expressly incorporated herein by reference and are intended to be encompassed by the claims. No claim element of a claim is to be interpreted under 35 U.S.C. § 112(f) unless the claim element expressly includes the phrase "means for" or "step for."

Use of ordinal terms such as "first," "second," "third," etc., in the claims to modify a claim element does not by itself connote any priority, precedence, or order of one claim element over another, the temporal order in which acts of a method are performed, the temporal order in which instructions executed by a device are performed, etc., but are used merely as labels to distinguish one claim element having a certain name from another element having a same name (but for use of the ordinal term) to distinguish the claim elements.

What is claimed is:

1. A method of antisurge control for a turbocompressor system including an antisurge controller, the method comprising:

storing, in a memory of the antisurge controller, multiple control algorithms;

identifying, by the antisurge controller, capabilities of field devices in the turbocompressor system, wherein the field devices include an antisurge valve and multiple sensors, and wherein the identifying includes sending a polling request, to one or more of the field devices and receiving, from the one or more of the field devices, a polling response that includes the capabilities of the one or more field devices;

selecting, by the antisurge controller, one of the multiple control algorithms and one or more operating features of the field devices based on the identified capabilities; and applying, by the antisurge controller, the selected control algorithm to the turbocompressor system.

2. The method of claim 1, further comprising:

receiving process feedback from the field devices;

determining; by the antisurge controller, that the process feedback has a monitoring impact;

identifying, by the antisurge controller and in response to the determining, updated capabilities of field devices in the turbocompressor system; and selecting, by the antisurge controller, another one of the multiple control algorithms based on the updated capabilities.

3. The method of claim 2, wherein receiving the process feedback from the field devices includes:

receiving raw data from the field devices.

4. The method of claim 2, wherein receiving the process feedback from the field devices includes:

receiving a signal indicating a pre-diagnosed condition of one of the field devices.

5. The method of claim 2, further comprising:

providing, via a user interface associated with the antisurge controller, an alert signal indicating the selection of the other one of the multiple control algorithms.

6. The method of claim 1, further comprising receiving process feedback from the field devices; and determining, by the antisurge controller, that the process feedback does not have a monitoring impact.

7. The method of claim 1, further comprising:

receiving process feedback from the field devices; and displaying, by the antisurge controller, the process feedback from the field devices for the turbocompressor system.

8. The method of claim 1, wherein identifying capabilities of the field devices comprises:

identifying self-diagnostic capabilities of the one or more field devices.

9. The method of claim 1, further comprising:

displaying, by the antisurge controller and via a user interface, the capabilities of the one or more field devices.

10. The method of claim 1, wherein the one or more field devices includes an antisurge valve, a pressure transmitter, and a flow transmitter, and wherein the polling response from each of the one or more field devices is received with a different format.

11. The method of claim 1, further comprising:

comparing, by the antisurge controller, a data configuration from the polling response with a corresponding data configuration of the antisurge controller; and generating, by the antisurge controller, an alert signal when a discrepancy is detected, based on the comparing, between the data configuration from the polling response and the corresponding data configuration.

12. The method of claim 1, further comprising:

invoking, by the antisurge controller and based on the polling response, a calibration algorithm of a control valve actuator to set parameters of the control valve actuator.

13. The method of claim 1, wherein the capabilities include one or more of:

stiction detection, or valve erosion detection.

14. The method of claim 1, wherein selecting one of the multiple control algorithms includes:

selecting the one of the multiple control algorithms that has a smallest surge control margin, of the surge control margins in the multiple control algorithms that are supported by the identified capabilities.

15. An antisurge controller for a turbocompressor system, comprising:

a memory device for storing instructions;

a communication interface for receiving data from field devices in the turbocompressor system; and a processor configured to execute the instructions to:

store, in the memory, multiple control algorithms, obtain, via the communication interface, a list of capabilities of field devices in the turbocompressor system, wherein the field devices include an antisurge valve and multiple sensors, display, via a user interface, parameters for the capabilities of the field devices, select one of the multiple control algorithms based on the identified capabilities, and apply the selected control algorithm to the turbocompressor system.

16. The antisurge controller of claim 15, wherein the processor is further configured to execute the instructions to:

identify, after the applying, updated capabilities of the field devices in the turbocompressor system; and select another one of the multiple control algorithms based on the updated capabilities.

17. The antisurge controller of claim 16, wherein, when identifying the updated capabilities, the processor is further configured to execute the instructions to:

receive process feedback from the field devices; and determine that the process feedback has a monitoring impact.

18. The antisurge controller of claim 17, wherein, when receiving the process feedback from the field devices, the processor is further configured to execute the instructions to:

receive a signal indicating a pre-diagnosed condition of one of the field devices.

19. The antisurge controller of claim 15, wherein, when obtaining a list of capabilities of field devices, the processor is further configured to execute the instructions to:

send a polling request to one or more of the field devices; and receive, from the one or more of the field devices, a polling response that includes the capabilities of the one or more field devices.

20. The antisurge controller of claim 15, wherein, when obtaining a list of capabilities of field devices, the processor is further configured to execute the instructions to:

receive polling responses with different formats from the one or more field devices.

21. The antisurge controller of claim 15, wherein, when obtaining a list of capabilities of field devices, the processor is further configured to execute the instructions to:

identify one or more valve response times for the field devices, and wherein, when selecting one of the multiple control algorithms based on the identified capabilities, the processor is further configured to execute the instructions to:

invoke an algorithm to prevent rundown surge when the one or more valve response times meet required valve response times to the algorithm to prevent rundown surge.

22. A non-transitory computer-readable medium containing instructions executable by at least one processor, the computer-readable medium comprising one or more instructions to:

store; in a memory, multiple surge control algorithms for a turbocompressor system;

obtain, via a communication interface, a list of capabilities of field devices in the turbocompressor system, wherein the field devices include an antisurge valve and multiple sensors, and wherein the obtaining includes sending a polling request to one or more of the field devices and receiving, from the one or more of the field devices, a polling response that includes the capabilities of the one or more field devices;

select one of the multiple surge control algorithms based on the identified capabilities; and apply the selected surge control algorithm to the turbocompressor system.

23. The non-transitory computer-readable medium claim 22, further comprising one or more instructions to:

identify, after the applying, updated capabilities of the field devices in the turbocompressor system; and select another one of the multiple surge control algorithms based on identifying the updated capabilities.

24. An antisurge controller for a turbocompressor system, comprising:

a memory device for storing instructions;

a communication interface for receiving data from field devices in the turbocompressor system; and a processor configured to execute the instructions to:

send a polling request to one or more field devices in the turbocompressor system, wherein the field devices include an antisurge valve and multiple sensors, receive, from the one or more of the field devices, a polling response that includes the capabilities of the one or more field devices, compare a data configuration from the polling response with a corresponding data configuration of the antisurge controller, and generate an alert signal when a discrepancy is detected between the data configuration from the polling response and the corresponding data configuration, based on the comparing.

25. The antisurge controller of claim 24, wherein the processor is further configured to execute the instructions to:

automatically update the corresponding data configuration to match the data configuration from the polling response.

* * * * *